US006396385B1

(12) United States Patent
Onishi et al.

(10) Patent No.: US 6,396,385 B1
(45) Date of Patent: May 28, 2002

(54) VARIABLE RESISTOR

(75) Inventors: Katsuhiro Onishi, Sabae; Yukinori Ueda, Fukui-ken, both of (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/626,463

(22) Filed: Jul. 26, 2000

(30) Foreign Application Priority Data

Jul. 30, 1999 (JP) ..... 11-216091

(51) Int. Cl.[7] ..... H01C 10/32

(52) U.S. Cl. ..... 338/162; 338/164; 338/150; 338/152

(58) Field of Search ..... 338/162, 163, 338/164, 150, 152, 184

(56) References Cited

U.S. PATENT DOCUMENTS 3,096,499 A * 7/1963 Hudson et al. ..... 338/162
3,124,775 A * 3/1964 Hamelberg ..... 338/162
3,601,743 A * 8/1971 Mathison et al. ..... 338/164
3,654,581 A * 4/1972 Franz, Jr. ..... 338/162
3,697,922 A * 10/1972 Hammond ..... 338/163
4,810,994 A * 3/1989 Froebe et al. ..... 338/162
5,144,277 A * 9/1992 Ishihara et al. ..... 338/164
5,912,614 A * 6/1999 Yasuda et al. ..... 338/162
5,982,272 A * 11/1999 Masuda ..... 338/162
6,005,473 A * 12/1999 Ishihara ..... 338/162

FOREIGN PATENT DOCUMENTS

JP 10-149907 6/1998

* cited by examiner

*Primary Examiner*—Karl D. Easthom
(74) *Attorney, Agent, or Firm*—Burns, Doane, Swecker & Mathis, LLP

(57) ABSTRACT

A variable resistor includes at least two sliders fixed to the bottom of the concavity of a case, a rotor having an engaging portion for engagement with a tool, on the upper side thereof and rotatably received in the concavity of the case, a resistor substrate having a resistor and an electrode on the underside thereof, capable of being sliding-contacted with the slider, and attached to the underside of the rotor, a cover attached to the opening of the concavity of the case and held in such a manner that the rotor is restrained from rising and is rotatable, and an o ring performing the seal between the inner peripheral surface of the concavity of the case and the outer peripheral surface of the rotor. The rotor has a step portion formed in the outer peripheral surface on the underside thereof with the lower-side portion of the step portion having a short diameter. The resistor substrate is formed into a disk-shape having a diameter longer than that of the short diameter portion of the step portion of the rotor. The O ring is prevented from being released by fixing the resistor substrate to the underside of the rotor.

10 Claims, 9 Drawing Sheets

VARIABLE RESISTOR

BACKGROUND OF THE INVENTION

1. Field of the Invention

The present invention relates to a seal structure suited for a variable resistor, especially a small-sized variable resistor for use in measuring instruments, communication equipment, sensors, and other industrial apparatuses or equipment.

2. Description of the Related Art

In recent years, there has been the general tendency that apparatuses or equipment is generally miniaturized and small-sized. Regarding the variable resistors which are internal parts of the apparatuses or equipment, the miniaturization has been advanced. In some cases, the apparatuses or equipment is used in a high moisture environment. Accordingly, for the variable resistors, a water-proof, moisture-proof structure is required.

Generally, a variable resistor comprises a case having a concavity, a resistor substrate having a resistor formed on the surface thereof and disposed on the bottom of the concavity of the case,.and a rotor having a slider fixed to the underside thereof and received rotatably in the concavity of the case. The resistance can be changed by sliding the slider on the resistor of the resistor substrate. The above-mentioned rotor is rotatable with respect to the case. Accordingly, sealing between the rotor and the case is needed. For this purpose, a peripheral groove is formed in the outer periphery of the rotor, and an O ring is disposed into the peripheral groove to perform the seal between the rotor and the case.

However, it is a troublesome work to fit the O ring into the peripheral groove of the rotor. Especially, it is very difficult to fit an O ring into the peripheral groove of a small-sized rotor accurately with the O ring being stretched to be enlarged. Fitting defects readily occur, causing imperfect sealing.

As disclosed in Japanese Unexamined Patent Application Publication No. 10-149907, a variable resistor is known, in which a slider is fixed to the bottom of the concavity of a case, a resistor substrate is attached to the underside of a rotor with the resistor of the substrate facing downward, and the slider is slidable in contact with the resistor. In this variable resistor, to render water-proof and moisture-proof properties, an O ring is placed between the upper side of the rotor and the upper side of the case, and by pressing a cover against the O ring, sealing between the rotor and the case is attained.

In this instance, it is unnecessary to fit the O ring onto the rotor with the O ring being stretched to be enlarged as in the above-described first conventional example. The assemblage workability is advantageously enhanced.

However, in the above-described second conventional example, the rotor is in the rising state during assemblage, due to the spring force of the slider, and therefore, the outer peripheral surface of the O ring is not guided by the case, that is, the O ring is simply placed on the outer periphery in the upper side of the rotor. Thus, the O ring is positioned in the unstable state. In this state, the positional slip or release of the O ring readily occurs if a transportation-vibration or the like is applied at assemblage. If the assemblage is carried out in the state that the O ring is positionally slipped, the O ring will be incorrectly engaged there, causing the imperfect sealing.

SUMMARY OF THE INVENTION

Accordingly, it is an object of the present invention to provide a variable resistor in which an O ring can be incorporated simply and stably, and imperfect seal is prevented.

It is another object of the present invention to provide a variable resistor of which the number of parts is not increased, and the miniaturization can be realized, due to the O ring of which the release is prevented by utilization of the existing parts.

To achieve the above-described objects, according to the present invention, there is provided a variable resistor which includes a case having a reception space, a slider fixed in the bottom of the reception space of the case, a rotor rotatably received in the reception space of the case, a resistor substrate having a resistor formed on the underside thereof and slidable in contact with the slider, and attached to the underside of the rotor, and an O ring performing the seal between the inner peripheral surface of the reception space of the case and the outer peripheral surface of the rotor, the rotor having a step portion formed in the outer peripheral surface on the underside thereof with the lower-side portion of the step portion having a short diameter, the O ring being fitted onto the short diameter portion of the step portion, the whole or a part of the resistor substrate being formed so as to have a diameter longer than that of the short diameter portion of the step portion of the rotor, and the resistor substrate being fixed to the underside of the rotor whereby the O ring is held between the step portion of the rotor and the resistor substrate.

According to the present invention, there is provided a variable resistor which includes a case-having a reception space, a resistor substrate having a resistor on the upper side thereof and disposed in the bottom of the reception space of the case, a rotor rotatably received in the reception space of the case, a slider slidable in contact with the resistor and attached to the underside of the rotor, and an O ring performing the seal between the inner peripheral surface of the reception space of the case and the outer peripheral surface of the rotor, the rotor having a step portion formed in the outer peripheral surface on the underside thereof with the lower-side portion of the step portion having a short diameter, the O ring being fitted onto the short diameter portion of the step portion, the whole or a part of the slider being provided with a base sheet portion having a diameter longer than that of the short diameter portion of the step portion of the rotor, the base sheet portion of the slider being fixed to the underside of the rotor, whereby the O ring is held between the step portion of the rotor and the base sheet portion of the slider.

In the variable resistor according to the present invention, for assemblage, first, the O ring is fitted onto the short diameter portion of the step portion of the rotor, and the resistor substrate is fixed to the underside of the rotor, whereby the O ring is prevented from being released in the axial direction. In this state, the rotor having the resistor substrate fixed thereto is inserted into the reception space of the case. Since the slider is fixed in the bottom of the reception space of the case, the slider and the resistor substrate are contacted together under pressure so that the rotor gets into the rising state. However, since the O ring is prevented from being released, due:to the step portion of the rotor and the resistor substrate, no positional sipping or releasing occurs. The O ring is prevented from being incorrectly engaged or being detached. Thus, the sealing performance is secured.

Further, for incorporation of the O ring, it is needed simply to insert the O ring onto the short diameter portion of the rotor and attach the resistor substrate to the underside of the rotor. Accordingly, it is unnecessary to stretch the O ring for enlargement. The attachment can be performed simply and stably, even if the rotor and the O ring are small-sized parts. Further, the resistor substrate prevents the O ring from being released. Thus, an especial part for preventing the release of the O ring is unnecessary, and the number of the parts is not increased. In addition, since the resistor substrate is attached directly to the underside of the rotor, the height of the rotor can be reduced, which serves to miniaturize the variable resistor.

As a method of attaching the resistor substrate to the underside of the rotor, adhesion, heat caulking, screwing, and so forth may be used. Preferably, a protuberance is formed in the underside of the rotor, an engaging portion into which the protuberance is fitted under pressure is formed in the resistor substrate, and the protuberance of the rotor is fitted under pressure into the engaging portion of the resistor substrate, whereby the rotor and the resistor substrate are joined together integrally, rotatably. By this, the assemblage can be easily performed as compared with other fixing methods. In addition, desirably, eliminated are conduction defects which may be caused by an adhesive or the like adhering to the resistor and an electrode. After the rotor is incorporated into the case, the resistor substrate is pressed by the spring force of the slider so as to be further fitted onto the rotor. Accordingly, there is no possibility that the resistor substrate is released from the rotor while the variable resistor is used.

As regards the method of incorporating the rotor into the case, it is not restrictive that the slider is fixed to the bottom of the case beforehand, and the rotor is incorporated from the upper side. Preferably, a restraining wall for restraining the rotor from being released upward is formed on the upper end of the case, the rotor is inserted through an open portion provided in the bottom of the case, and a slider block having the slider fixed thereto is fitted into the open portion in the bottom of the case. In this instance, preferably, the gap between the open portion in the bottom of the case and the slider block is sealed with a resin to perform both of the fixing and the sealing between the open portion and the slider block.

According to the present invention, the arrangement of the slider and the resistor substrate is reversed as compared with that according to the first aspect of the present invention. That is, the resistor substrate is provided in the bottom of the case, and the slider is attached to the underside of the rotor. The resistor substrate may be formed separately from or integrally with the case.

In this instance, the O ring is prevented from being released by forming in the slider a base sheet portion of which the diameter is wholly or partially longer than that of the short diameter portion of the step portion of the rotor, and fixing the base sheet portion to the underside of the rotor. Accordingly, the O ring can be securely attached without the positional slipping or departing of the O ring occurring. Also in this instance, for the attachment, the O ring is simply inserted onto the short diameter portion of the step, portion of the rotor. Thus, the incorporation work can be easily performed, even if the rotor and the O ring are small-sized parts.

Preferably, a protuberance is formed in the underside of the rotor, and fitted under pressure into an engaging portion formed in the base sheet portion of the slider, whereby the rotor and the base sheet portion of the slider are joined together. This assemblage can be easily performed as compared with other fixing methods.

Also preferably, the rotor is incorporated into the case from the lower side thereof, the open portion in the bottom of the case is closed with the resistor substrate, and moreover, is sealed with a resin.

Preferably, the upper side of the case is provided with an open portion to which a part of the rotor is exposed, and in the open portion of the case, a cover for restraining the rotor from rising and holding the rotor rotatably is attached. In this instance, the rotor can be incorporated into the case form the upper side thereof. If the case is formed so as to be bottomed, it is unnecessary to seal the bottom of the case with a resin.

DESCRIPTION OF PREFERRED EMBODIMENT

Figure 1:
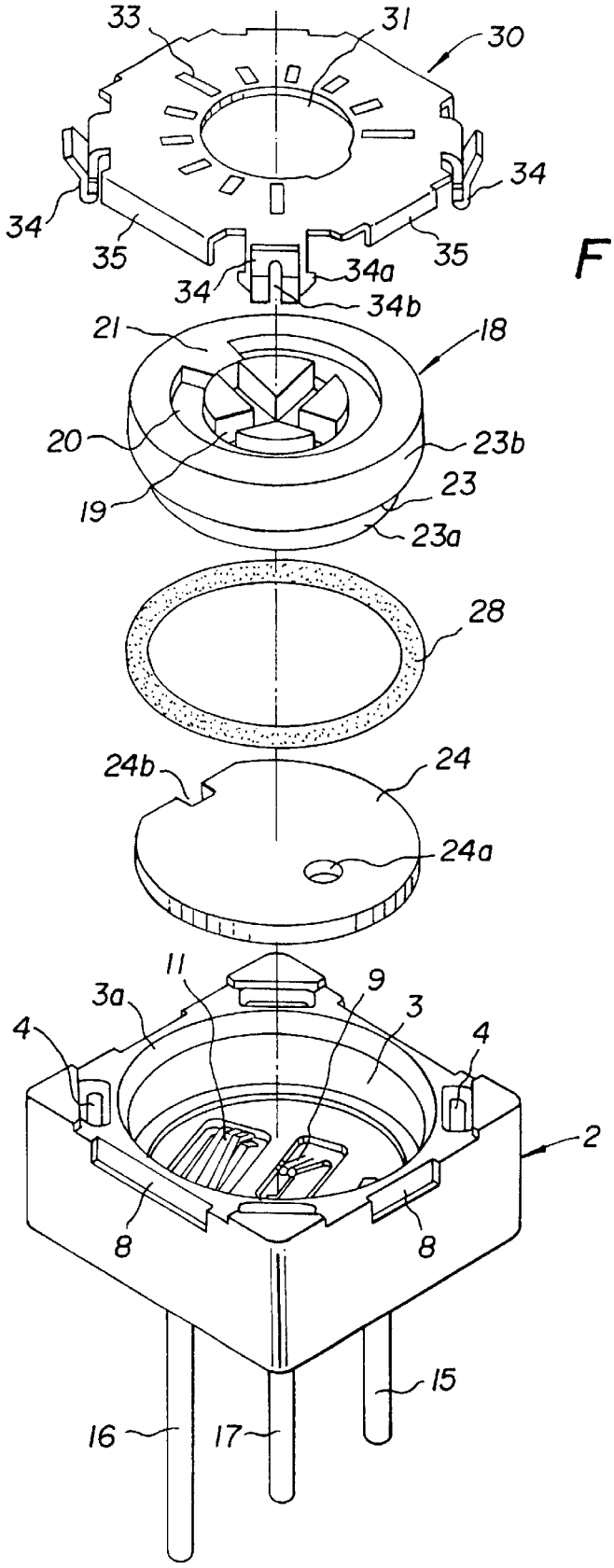
FIG. 1 is an exploded perspective view of a variable resistor according to a first embodiment of the present invention.
Figure 2:
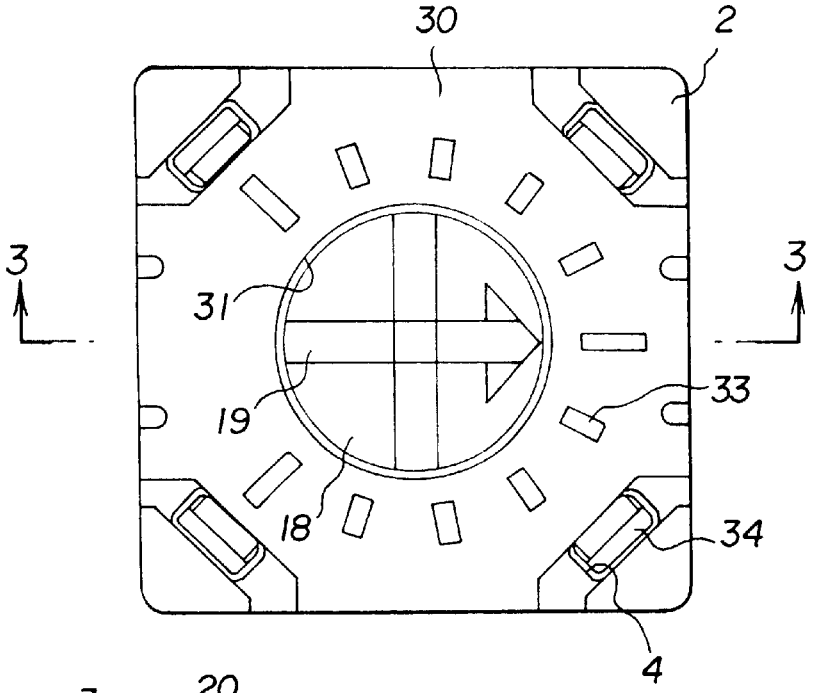
FIG. 2 is a plan view of the variable resistor of FIG. 1.

FIGS. 1 to 8 show a variable resistor according to a first embodiment of the present invention. The variable resistor 1 comprises a case 2, slider 9, 10, and 11, lead terminals 15, 16, and 17, a rotor 18, a resistor substrate 24, an O ring 28, and a metallic cover 30.

The case 2, which is required to be durable to heat generated at soldering and can act stably in a high temperature environment, is formed from a thermoplastic resins such as polyamide types with high heat resistance, e.g., 46 nylon, polyphenylenesulfide, polybutyleneterephthalate, liquid crystal polymers, or the like, or a thermosetting resin such as epoxy, diallyl phthalate, or the like. A bottomed concavity 3 having a circular transverse cross-section, which is an example of the receiving space, is formed in the case 2, and is designed in such a manner that the rotor 18 received in the concavity 3 can be smoothly rotated. A tapered guide surface 3*a* for guiding the O ring 28 is formed in the upper edge of the concavity 3 of the case 2. Engaging holes 4 to be engaged with the attachment claws 34 of the cover 30 are formed in the four corners on the upper side of the case 2, respectively. Engaging recesses 8 to be engaged with the engaging pieces 35 of the cover 30 are formed in the four side portions on the upper side of the case 2, respectively.

Figure 3:
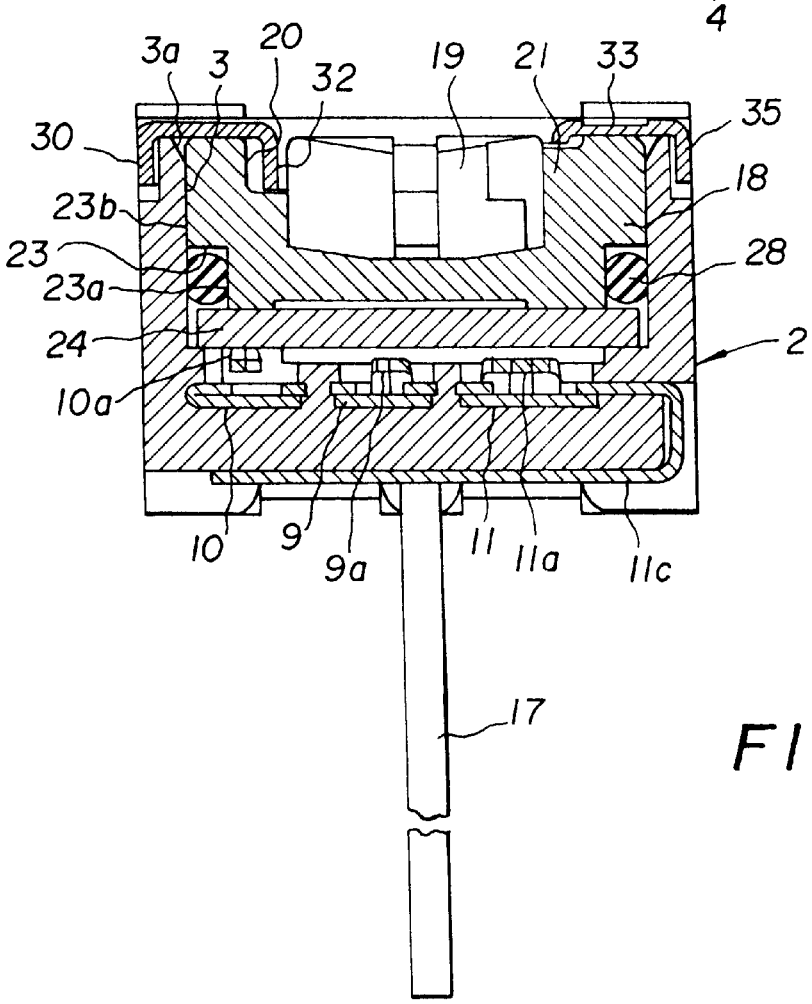
FIG. 3 is a cross-sectional view taken along line A—A in FIG. 2.

The sliders 9, 10, and 11 are formed from a metallic sheet of copper alloys such as nickel silver, stainless steel or the like, insert-molded with the underside of the case 2, and partially exposed to the bottom surface of the concavity 3 of the case 2. The sliders 9, 10 and 11 each have a double-folding structure, as shown in FIG. 3. In the upper sheet portions of the sliders 9, 10, and 11, comb-shaped arms 9*a*, 10*a*, and 11*a* are formed in such a manner as to protrude obliquely upward from the bottom surface of the concavity 3. Contacts 9*b*, 10*b*, and 11*b* (see FIG. 5) are formed in the tips of the arms 9*a*, 10*a*, and 11*a*, respectively (see FIG. 5). The contacts 9*b*, 10*b*, and 11*b* can be contacted with the center electrode 26, the outer peripheral electrode 27, and the resistor 25 of the resistor substrate 24 which will be described later.

A land (not shown) is provided with the slider 9. The land is exposed to an opening 5 for connection of a lead terminal provided on the underside of the case 2 (see FIG. 4). Similarly, a land (not shown) is provided with the slider 10 and exposed to an opening 6 for connection of a lead terminal provided on the underside of the case 2. The lead portion 11*c* of the slider 11, led out through the side face of the case 2, is folded from the side face onto the underside of the case 2.

Figure 4:
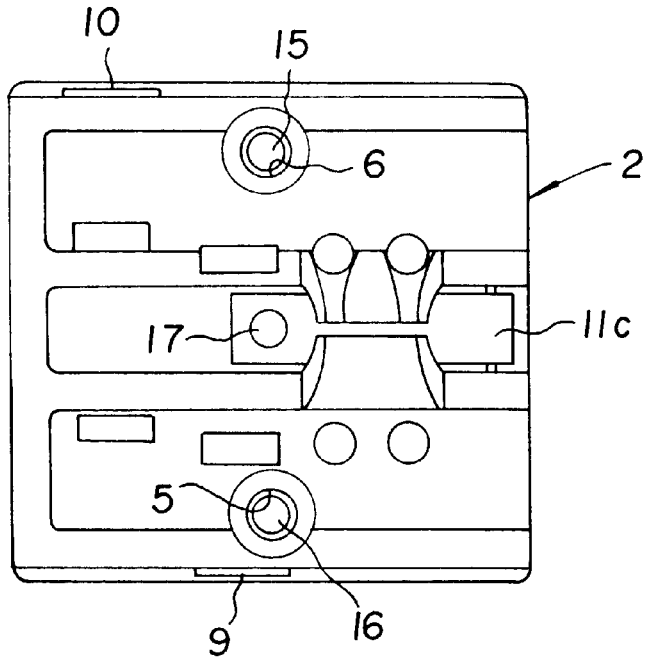
FIG. 4 is a bottom view of the variable resistor of FIG. 1.
Figure 5:
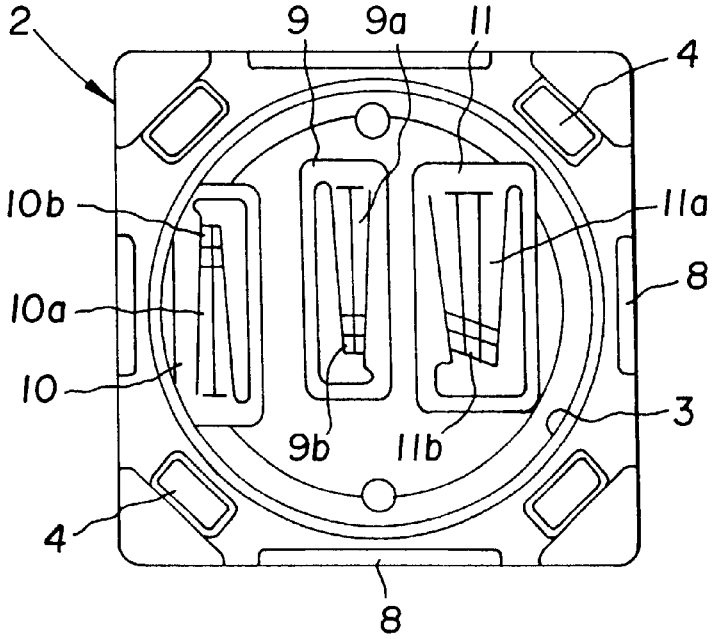
FIG. 5 is a plan view of the case of the variable resistor of FIG. 1.
Figure 6:
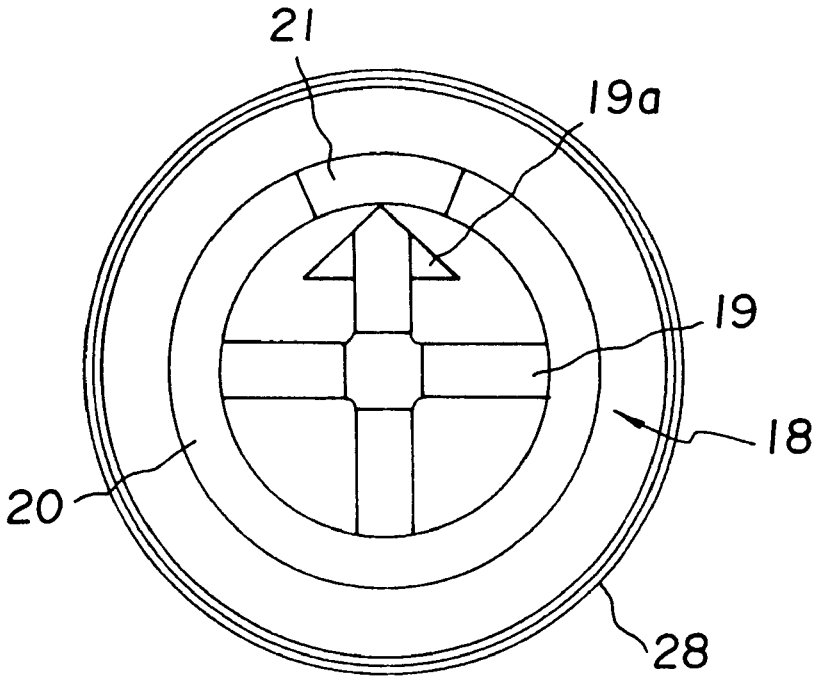
FIG. 6 is a plan view of the rotor and the resistor substrate of the variable resistor of FIG. 1.
Figure 7:
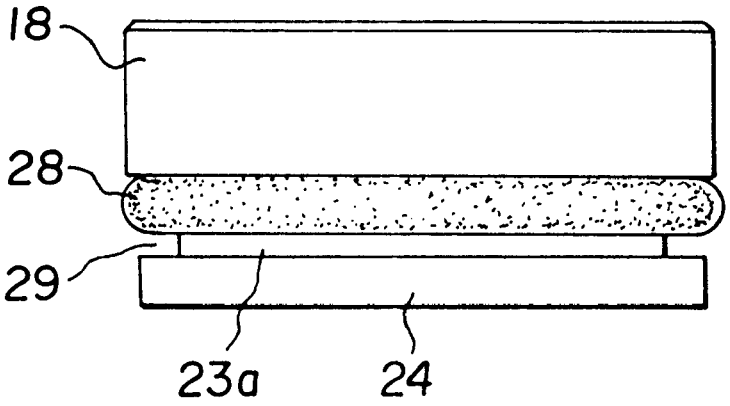
FIG. 7 is a side view of the rotor and the resistor substrate shown in FIG. 6.
Figure 8:
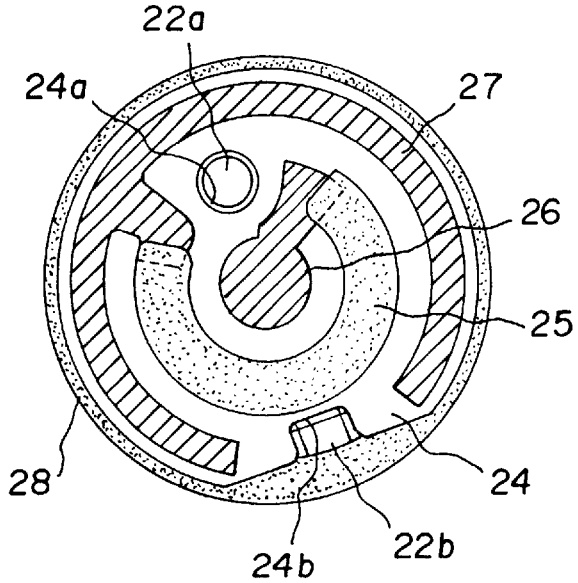
FIG. 8 is a bottom view of the rotor and the resistor substrate shown in FIG. 6.

In this embodiment, as the lead terminals 15, 16, and 17, pin terminals each having a circular cross-section are employed, as shown in FIGS. 1 and 4. The lead terminals 15 and 16 are connected to the lands of the sliders 9 and 11 exposed to the openings 5 and 6 formed in the underside of the case 2, respectively, in a method such as soldering, resistance welding, supersonic welding, or the like. The lead terminal 17 is connected to the lead portion 11*c* of the slider 11 folded onto the underside of the case 2.

The rotor 18 is formed into a substantially columnar shape, e.g., from a ceramic material such as alumina, or a heat resistant resin such as polyphenylenesulfide or the like. The outer peripheral surface of the case 2 are positioned near to the inner peripheral surface of the concavity 3. Tool-engagement grooves 19 with which a tool such as a screwdriver or the like is to be engaged are formed in the center of the upper side of the rotor 18, and exposed upward in the concavity 3 of the case 2. An arrow portion 19*a* for indicating the direction of the rotor 18 is provided at the tool-engagement grooves 19. An escaping groove 20 having a substantially arch shape is provided around the tool-engagement grooves 19, and a stopper 21 is provided at a predetermined position in the escaping groove 20. A round-rod shaped protuberance 22*a* and a claw-shaped protuberance 22*b* are provided in the underside of the rotor 18 (see FIG. 8). A step portion 23 is formed in the outer periphery on the underside of the rotor 18 with the lower portion of the step portion 23 having a short diameter.

The resistor substrate 24 is attached to the underside of the rotor 18. The resistor substrate 24 is formed into a disk shape from a ceramic material such as alumina or the like, a heat resistant resin such as polyphenylenesulfide or the like. The diameter of the resistor substrate 24 is longer than that of the short diameter portion 23*a* of the step portion 23 of the rotor 18 and is shorter than or equal to that of the large diameter portion 23*b* of the step portion 23. The resistor substrate 24 is provided with a hole 24*a* and a notch 24*b* of which the shapes are conformed to the protuberances 22*a* and 22*b*, respectively. The rod-like protuberance 22*a* is inserted under pressure into the hole 24*a*, and the claw-like protuberance 24*b* is engaged with the notch 24*b*, so that the resistor substrate 24 is fixed to the rotor 18 concentrically and securely rotatably therewith. When the resistor substrate 24 is attached to the rotor 18, a reception groove 29 for the O ring 28 is defined by the step portion 23 of the rotor 18 and the resistor substrate 24. A substantially C-character-shaped resistor 25 formed of e.g., a cermet resistor or a carbon resistor is formed in a method such as screen printing, transfer, or the like. The both ends of the resistor 25 are electrically connected to the center electrode 26 and the outer peripheral electrode 27 which are formed concentrically with the resistor 25.

The O ring 28 is received in the reception groove 29 formed by the step portion 23 of the rotor 18 and the resistor substrate 24, as described above. The outer peripheral surface of the O ring 28 is protruded to some degree from the outer peripheral surface of the large diameter portion 23*b* of the rotor 18. Desirably, the O ring 28 is made of a silicone rubber or the like which is heat-resistant. When the rotor 18 is incorporated in the concavity 3 of the case 2, the outer peripheral surface of the O ring 28 is contacted under pressure with the inner peripheral surface of the concavity 3 of the case 2, while the inner peripheral surface of the O ring 28 is contacted under pressure with the short diameter portion 23*a* of the step portion 23 of the rotor 18. Thus, the seal between the case 2 and the rotor 18 is secured.

The cover 30 is made of a metal material such as stainless steel or the like. A screwdriver insertion-hole 31 is formed in the center of the cover 30, and through the hole 31, the tool-engagement grooves 19 of the rotor 18 are exposed, as shown FIGS. 1 and 2. A part of the inner edge of the insertion hole 31 is bend downward to form a tongue stopper-receiver 32 (see FIG. 3). The stopper-receiver 32 is engaged with the arched escaping groove 20 of the rotor 18. The stopper 21 of the rotor 18 is brought into contact with the stopper-receiver 32 to control the rotation angle of the rotor 18. A calibration 33 for indicating the rotational position of the rotor 18 is carved on the top surface of the cover 30. In the four corners of the cover 30, the fixing claws 34 are bent downward, respectively. The tips of the claws 34 are bent upward, respectively. Release-prevention protuberances 34*a* are provided on the opposite sides in the width directions of the claws 34, respectively, as shown in FIG. 1. Slits 34*b* are formed in the centers in the width directions of the claws 34, respectively. The slits 34*b* cause the claws 34 to have an elasticity in the width directions, respectively. The protuberances 34*a* are engaged with the inner edges of the engaging holes 4 of the case 2, respectively, whereby the cover 30 is prevented from being released from the case 2. Engaging pieces 35 bend downward are formed protuberantly in the four side portions of the cover 30, and are engaged with engaging recesses 8 formed in the outer periphery on the upper side of the case 2. Thus, the engaging pieces 35 have a function of preventing the cover 30 from being transversely slipped.

Hereinafter, an assembly method for the variable resistor 1 of the above-described embodiment will be described.

First, the rotor 18 and the resistor substrate 24 are assembled. In particular, the O ring 28 is inserted onto the short diameter portion 23*a* of the step portion 23 of the rotor 18. To the underside of the rotor 18, the resistor substrate 24 is attached with the resistor 25 and the electrodes 26 and 27 facing downward. Thereby, the release of the O ring 28 is prevented. In this instance, the insertion work can be easily performed, since the O ring 28 is simply inserted onto the short diameter portion 23*a* of the rotor 18. Further, for fixation of the resistor substrate 24 to the rotor 18, the protuberances 22*a* and 22*b* provided for the rotor 18 are simply engaged with the hole 24*a* and the notch 24*b* of the resistor substrate 24, respectively. Accordingly, even if they are small-sized parts with a size of about 1 to 2 mm, the workability is good.

Next, the rotor 18 having the resistor substrate 24 and the O ring 28 attached thereto is received into the concavity 3 of the case 2, and the electrodes 26 and 27 are brought into contact with the contacts 9*b*, 10*b*, and 11*b*, respectively. Then, the rotor 18 is in the rising state, due to the rebounding forces of the arms 9*a*, 10*a*, and 11*a* of the sliders 9, 10, and 11.

Thereafter, the case 2 is covered with the cover 30 from the upper side of the case 2, and the rotor 18 is pushed into the concavity 3. In this state, the fixing claws 34 of the cover 30 are inserted under pressure into the engaging holes 4 of the case 2 to be engaged with the holes 4, respectively. At the moment, the O ring 28 can be smoothly inserted into the concavity 3 of the case 2, since the outer peripheral surface of the O ring 28 is guided by the guide surface 3*a* on the upper edge of the concavity 3 of the case 2. The cover 30 is attached as described above, so that the outer peripheral surface of the O ring 28 is contacted under pressure with the inner peripheral surface of the concavity 3 of the case 2,.and the inner peripheral surface of the O ring 28 is contacted under pressure with the short diameter portion 23*a* of the step portion 23 of the rotor 18, whereby the inside of the case 2 is tightly sealed.

In the variable resistor 1 assembled as described above, by rotating the rotor 18 with a screwdriver with the tip thereof being pressed to the tool-engagement grooves 19 of the rotor 18, the contact 11*b* is slid on the resistor 25, and the contact 10*b* is slid on the outer peripheral electrode 27, with the contact 9*b* being kept in contact with the center electrode 26. Accordingly, the resistance between the terminals 15 and 17 or that between the terminals 16 and 17 can be changed. Then, the rotor 18 is stopped at a optional position. The rotation of the rotor 18 is regulated, due to the frictional force of the O ring 28 and the positions at which the resistor 25 and the electrodes 26, 27 are in contact with the contacts 9*b*, 10*b*, and 11*b* are prevented from changing. Thus, the resistances are stabilized.

Figure 9:
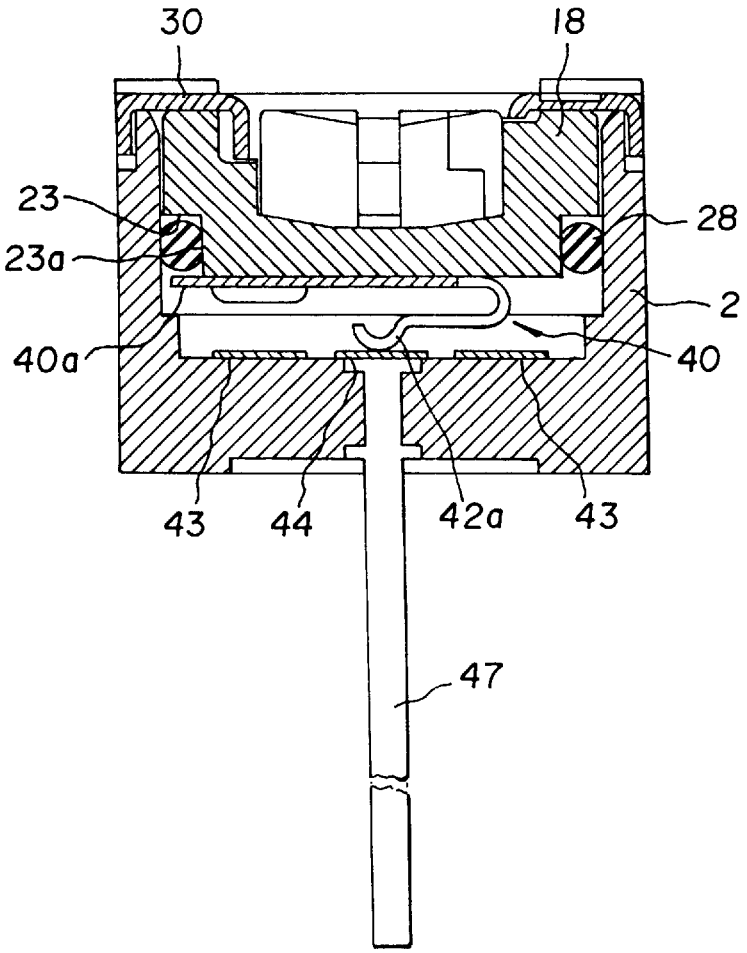
FIG. 9 is a cross sectional view of a variable resistor according to a second embodiment of the present invention.
Figure 10:
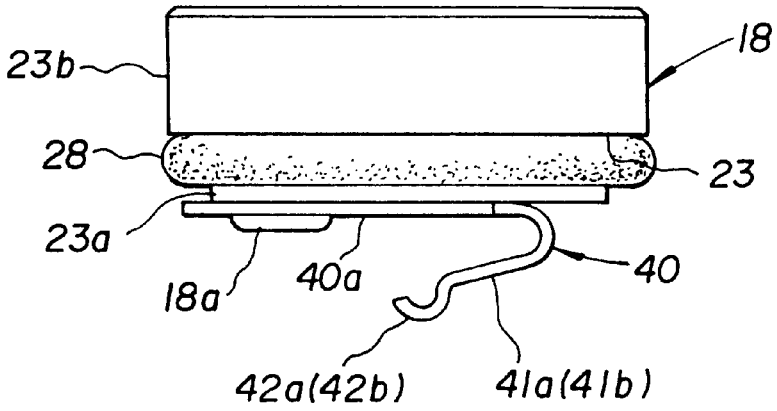
FIG. 10 is a side view of a rotor and a slider used in the variable resistor shown in FIG. 9.
Figure 11:
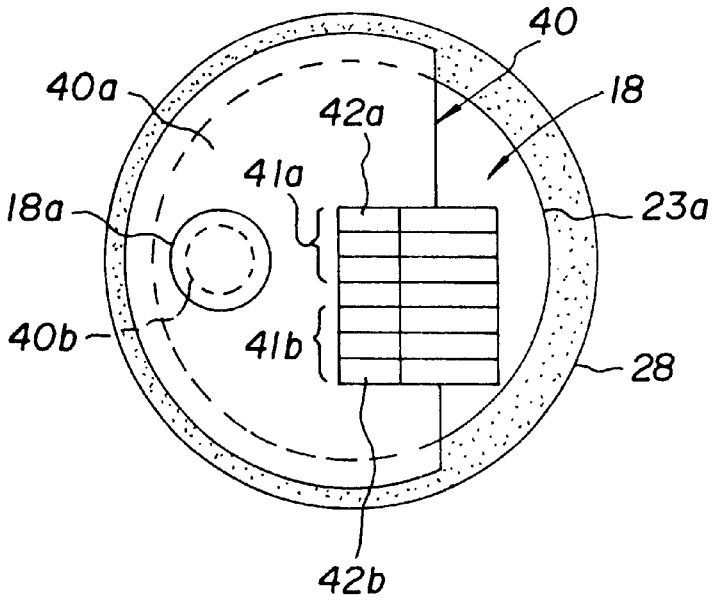
FIG. 11 is a bottom view of the rotor and the slider shown in FIG. 10.

FIGS. 9, 10, and 11 show a second embodiment of the present invention. In the second embodiment, the same reference numerals used in the first embodiment show similar or equivalent elements, and the description corresponding thereto is not repeated. In the second embodiment, sliders 40 are attached to a rotor 18, and a resistor 43 and an electrode 44 are formed in the bottom of a case 2, in contrast to the first embodiment.

A step portion 23 of which the lower portion has a short diameter is formed in the outer periphery on the underside of the rotor 18. An O ring 28 is fitted onto the short diameter portion 23*a* of the step portion 23 of the rotor 18. A single slider 40 is fixed to the underside of the rotor 18, as shown in FIGS. 10 and 11. The slider 40 is provided with a substantially disk-shaped base sheet portion 40*a*. Into a caulking hole 40*b* formed in the base sheet portion 40*a*, the convexity 18*a* of the rotor 18 is inserted, and heat-caulked, so that the slider 40 is fixed to the underside of the rotor 18. For the purpose of securing the fixation of the slider 40 to the rotor 18, plural concavities 18*a* may be provided, or an additional portion for stopping the rotation of the slider 40 may be provided, for example. As a means for fixing the slider 40 to the underside of the rotor 18, methods other than the heat caulking, such as pressure-fitting using a concavity and a convexity, adhesion, screwing, or the like may be employed.

The diameter of the base sheet portion 40*a* of the slider 40 is longer than the outer diameter of the underside (short diameter portion 23*a*) of the rotor 18, and is shorter or equal to the long diameter portion 23*b* of the step portion 23. Therefore, release of an O ring 28 is prevented by fixing the base sheet portion 40*a* of the slider 40 to the underside of the rotor 18 after the O ring 28 is fitted onto the short diameter portion 23*a* of the step portion 23 of the rotor 18. In the slider 40, plural comb-like arms 41*a* and 41*b* (in the figure, seven arms) extending downward from the base sheet portion 40*a*, having spring properties are formed by bending. Contacts 42*a* and 42*b* are formed in the tips of the arms 41*a* and 41*b*, respectively.

In the center of the bottom of the concavity 3 of the case 2, an electrode 44 is formed, and a substantially C-character shaped resistor 43 is formed concentrically around the electrode 44. Of the contacts 42*a* and 42*b* of the slider 40, the plural contacts 42*a* near to the rotation center are contacted with the center electrode 44, while the plural contacts 42*b* distant from the rotation center are sliding-contacted with the resistor 43. Three terminals 45, 46, and 47 connected to both ends of the above-described resistor 43 and the center electrode 44, lying in the bottom of the case 2, are insert-molded. The resistances are output-through these terminals.

The rotor 18 having the slider 40 fixed thereto is received into the concavity 3 of the case 2, and a cover 30 is pressed against there, whereby the O ring 28 is arranged between the short diameter portion 23*a* of the rotor 18 and the inner peripheral surface of the concavity 3 of the case 2, in contact under pressure with them. Thus, the seal between the rotor 18 and the case 2 is secured.

In the above-described embodiment, the resistor 43 and the electrode 44 are disposed directly to the bottom of the concavity 3 of the case 2. A resistor substrate having a resistor and an electrode formed on the surface thereof may be received and fixed in the concavity 3 of the case 2 with the surface facing upward.

Figure 12:
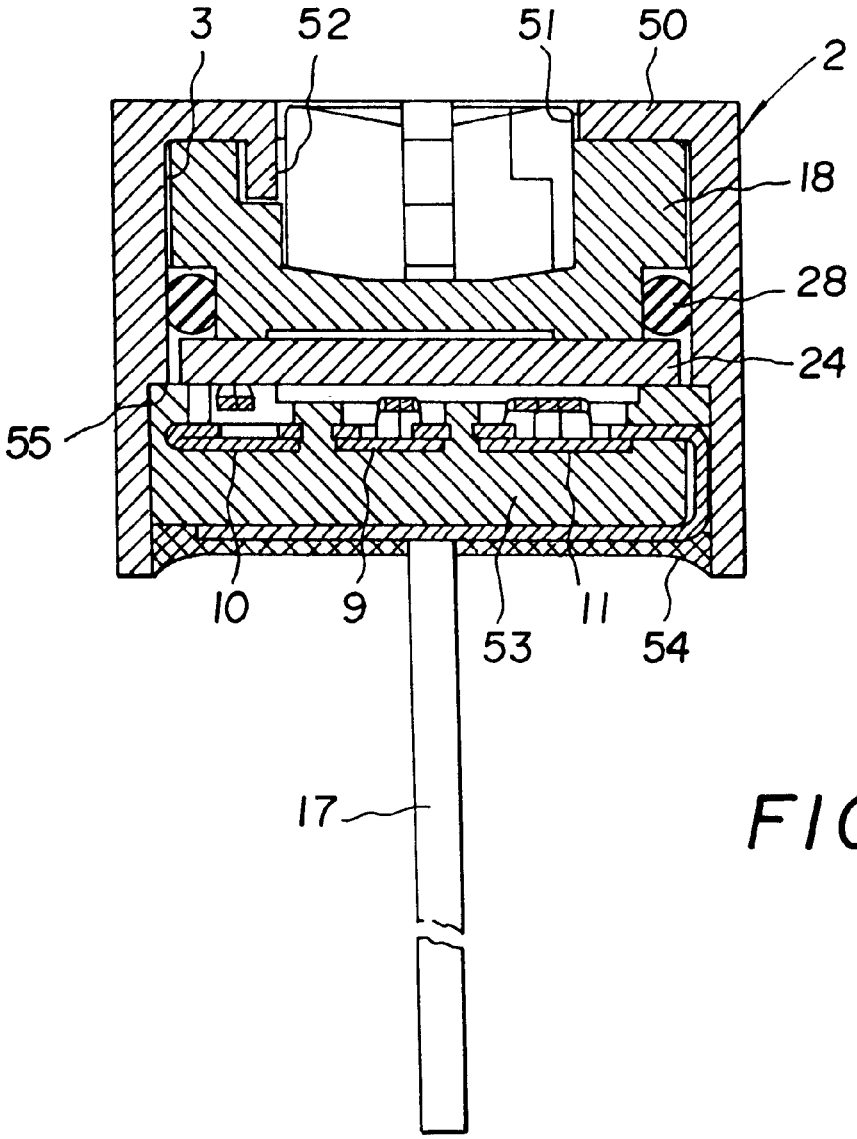
FIG. 12 is a cross sectional view of a variable resistor according to a third embodiment of the present invention.

FIG. 12 shows a third embodiment of the present invention, in which the first embodiment is partially changed. The same reference numerals used in the first and third embodiments show similar or equivalent elements, and the description corresponding thereto is not repeated.

In the third embodiment, the reception space 3 of a case 2 is opened upward and downward. Instead of the cover 30 mounted onto the upper side of the case 2, a restraining wall 50 for restraining the rotor 18 from being released upward is formed on and integrally with the upper end of the case 2. The inner periphery of the restraining wall 50 defines a screwdriver insertion hole 51. A stopper-receiver 52 is formed on and integrally with the inner edge of the screwdriver insertion hole 52. The rotor 18 having a resistor substrate 24 fixed thereto is inserted through the open portion in the bottom of the case 2. A slider block 53 having sliders 9, 10, and 11 fixed thereto is fitted into the open portion in the bottom of the case 2. The seal between the open portion in the bottom and the slider block 53 is performed with a resin 54. In the inner wall of the open portion in the bottom of the case 2, formed is a step portion 55 for positioning the slider block 53.

In this instance, when the rotor 18 is received in the case 2, and the slider block 53 is fitted into the open portion in the bottom of the case 2, the slider block 53 is ready to rise, due to the rebounding force of the sliders 9, 10, and 11. In the state that the slider block 53 is pressed against the-step portion 55 of the case 2, the resin 54 is cast into the concave portion defined by the open portion in the bottom of the case 2 and the slider block 53, and hardened, whereby the fixation and the sealing of the slider block 53 are simultaneously carried out.

Also in this embodiment, the release of the O ring 28 is prevented, due to the step portion 23 of the rotor 18 and the resistor substrate 24. Accordingly, no release of the O ring 28 is caused when the rotor 18 is incorporated in the case 2. Thus, the incorporation can be securely performed.

Figure 13:
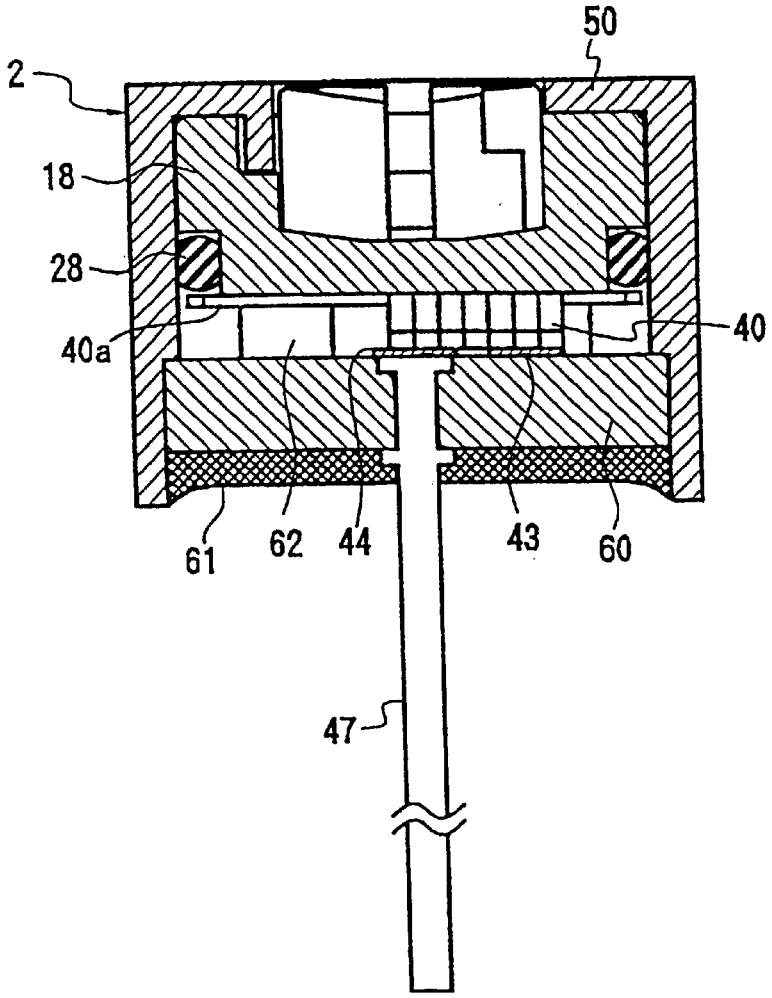
FIG. 13 is a cross sectional view of a variable resistor according to a fourth embodiment of the present invention.
Figure 14:
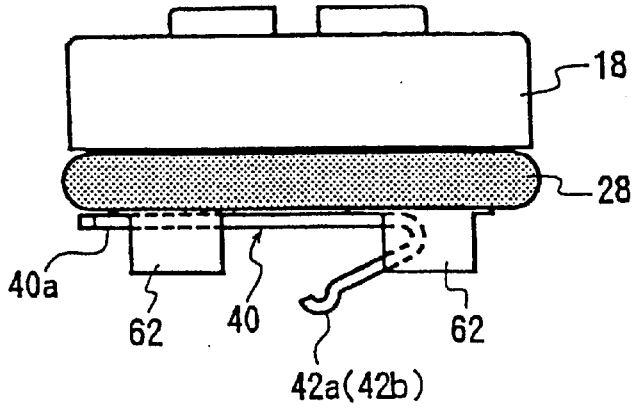
FIG. 14 is a side view of a rotor and a slider used in the variable resistor shown in FIG. 13.
Figure 15:
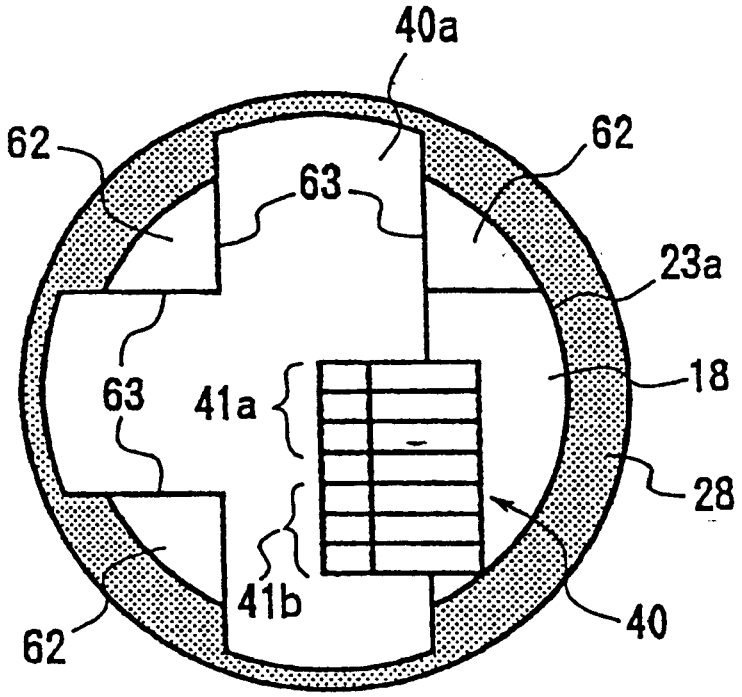
FIG. 15 is a bottom view of the rotor and the slider shown in FIG. 14.

FIG. 13 shows a fourth embodiment of the present invention, in which the second embodiment is partially changed. Similar elements in the second and fourth embodiments are indicated with the same reference numerals, and the description corresponding thereto is not repeated.

Also in this embodiment, the reception space 3 of a case 2 is opened upward and downward. A restraining wall 50 for restraining the rotor 18 from being released upward is formed on and integrally with the upper end of the case 2. The rotor 18 having a slider 40 fixed thereto is inserted through the open portion in the bottom of the case 2. Into the open portion in the bottom of the case 2, a resistor substrate 60 having a resistor 43 and an electrode 44 formed on the surface thereof is fitted. Seal between the open portion in the bottom and the resistor substrate 60 is performed with a resin 61.

In this embodiment, in order to fix the slider 40 to the underside of the rotor 18, three sectorial protuberances 62 are formed protuberantly on the underside of the rotor 18. Into the grooves 63 between these protuberances 62, the two sides elongating perpendicularly to each other of the base sheet portion 40*a* having a substantial T-character shape of the slider 40 are inserted under pressure to be fixed. Then, the O ring 28 can be securely prevented from being released, since the base sheet portion 40*a* having a substantial T-character shape of the slider 40 is protruded outward from the short diameter portion 23*a* of the step portion 23 of the rotor 18 toward the outer diameter side.

In this instance, it is necessary simply to insert the slider 40 into the rotor 18 under pressure. Accordingly, the attachment of the slider 40 to the rotor 18 can be performed more easily, as compared with the second embodiment (see FIGS. 10 and 11). In the free state, the contacts 42*a* and 42*b* of the slider 40 are protuberant downward from the protuberances 62. In the state that the rotor 18 and the resistor substrate 60 are incorporated into the case 2, the protuberances 62 are in contact with the upper side of the resistor substrate 60, so that the deflection of the contacts 42*a* and 42*b* are limited. Accordingly, advantageously, this prevents the contact pressures to increase unduly, which may be caused by variations in the incorporation.

The variable resistor of the present invention is not limited to the above-described embodiments, and may be variously changed without departing from the sprit and the scope of the present invention.

For example, in the above-described embodiments, the lead terminals 15, 16, and 17 are fixed to the sliders 9, 10, and 11, the lead terminals 45, 46, and 47 are fixed to the bottom of the case 2, and the lead terminals 45, 46, and 47 are fixed to the resistor substrate 60. However, the variable resistor of the present invention may be a surface mounting type variable resistor, not limited to the variable resistor having the lead terminals.

As understood in the above description, according to the present invention, the incorporation of the O ring can be easily performed, and moreover, the O ring is prevented from being positionally slipped or released, even if a transportation vibration is applied during assemblage, by inserting the O ring onto the short diameter portion of the step portion of the rotor, and attaching the resistor substrate to the underside of the rotor. Thus, when the rotor is incorporated into the case, the incorrect engagement of the O ring is prevented, and the sealing can be securely performed.

According to the present invention, the O ring is prevented from being released by inserting the O ring onto the short diameter portion of the step portion of the rotor, and attaching the slider to the, underside of the rotor. Similarly, incorrect engagement of the O ring can be prevented. A variable resistor having good sealing properties can be provided.

According to the present invention, the O ring is prevented from being released by utilization of the resistor substrate or the slider which is an existing part. An especial part for preventing the O ring from being released is not required. The number of the parts is not increased. The height of the rotor can be decreased. That is, a variable resistor small in size and having a simple structure can be provided.

What is claimed is:

1. A variable resistor comprising a case having a reception space, a slider fixed in the bottom of the reception space of the case, a rotor rotatably received in the reception space of the case, a resistor substrate having a resistor formed on the underside thereof and slidable in contact with the slider, and attached to the underside of the rotor, and an O ring performing the seal between the inner peripheral surface of the reception space of the case and the outer peripheral surface of the rotor, said rotor having a step portion formed in the outer peripheral surface on the underside thereof with the lower-side portion of the step portion having a short diameter, said O ring being fitted onto the short diameter portion of the step portion, the whole or a part of said resistor substrate being formed so as to have a diameter longer than that of the short diameter portion of the step portion of the rotor, and said resistor substrate being fixed to the underside of the rotor whereby the O ring is held between the step portion of the rotor and the resistor substrate.

2. A variable resistor according to claim 1, wherein the underside of the rotor is provided with a protuberance, the resistor substrate is provided with an engaging portion into which said protuberance is fitted under pressure, the protuberance of the rotor is fitted under pressure into the engaging portion of the resistor substrate, whereby the rotor and the resistor substrate are joined together integrally, rotatably.

3. A variable resistor according to claim 2, wherein the bottom of the case is provided with an open portion, the upper end of the case is provided with a restraining wall for restraining the rotor from being released upward, the rotor is inserted through the open portion in the bottom of the case, a slider block having the slider fixed thereto is fitted into the open portion in the bottom of the case, and said open portion in the bottom and said slider block is sealed and fixed with a resin.

4. A variable resistor according to claim 1, wherein the bottom of the case is provided with an open portion, the upper end of the case is provided with a restraining wall for restraining the rotor from being released upward, the rotor is inserted through the open portion in the bottom of the case, a slider block having the slider fixed thereto is fitted into the open portion in the bottom of the case, and said open portion in the bottom and said slider block is sealed and fixed with a resin.

5. A variable resistor according to claim 1, wherein the upper side of the case is provided with an opening to which a part of the rotor is exposed, and over the opening of the case, a cover for restraining the rotor from rising and holding the rotor rotatably is disposed.

6. A variable resistor comprising a case having a reception space, a resistor substrate having a resistor formed on the upper side thereof and disposed in the bottom of the reception space of the case, a rotor rotatably received in the reception space of the case, a slider attached to the underside of the rotor and slidable in contact with the resistor, and an O ring performing the seal between the inner peripheral surface of the reception space of the case and the outer peripheral surface of the rotor, said rotor having a step portion formed in the outer peripheral surface on the underside thereof with the lower-side portion of the step portion having a short diameter, said O ring being fitted onto the short diameter portion of the step portion, the whole or a part,of said slider being provided with a base sheet portion having a diameter longer than that of the short diameter portion of the step portion of the rotor, the base sheet portion of the slider being fixed to the underside of the rotor, whereby the O ring is held between the step portion of the rotor and the base sheet portion of the slider.

7. A variable resistor according to claim 6, wherein the underside of the rotor is provided with a protuberance, the base sheet portion of the slider is provided with an engaging portion into which said protuberance is fitted under pressure, the protuberance of the rotor is fitted under pressure into the engaging portion of the base sheet portion, whereby the rotor and the base sheet portion of the slider are joined together integrally, rotatably.

8. A variable resistor according to claim 7, wherein the bottom of the case is provided with an open portion, the upper end of the case is provided with a restraining wall for restraining the rotor from being released upward, the rotor is inserted through the open portion in the bottom of the case, the resistor substrate is fitted into the open portion in the bottom of the case, and said open portion in the bottom and the resistor substrate are sealed and fixed with a resin.

9. A variable resistor according to claim 6, wherein the bottom of the case is provided with an open portion, the upper end of the case is provided with a restraining wall for restraining the rotor from being released upward, the rotor is inserted through the open portion in the bottom of the case, the resistor substrate is fitted into the open portion in the bottom of the case, and said open portion in the bottom and the resistor substrate are sealed and fixed with a resin.

10. A variable resistor according to claim 6, wherein the upper side of the case is provided with an opening to which a part of the rotor is exposed, and over the opening of the case, a cover for restraining the rotor from rising and holding the rotor rotatably is disposed.

* * * * *